US006398915B1

(12) United States Patent
Fargeout

(10) Patent No.: US 6,398,915 B1
(45) Date of Patent: Jun. 4, 2002

(54) LEADER DEVICE FOR INSTALLATION OF ON MACHINE SEAMABLE PAPERMAKER'S FABRICS AND BELTS

(75) Inventor: Patrick Fargeout, Saint Martin de Riberac (FR)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 09/643,493

(22) Filed: Aug. 22, 2000

Related U.S. Application Data

(60) Provisional application No. 60/163,016, filed on Nov. 2, 1999.

(51) Int. Cl.[7] ..... D21F 1/24

(52) U.S. Cl. ..... 162/273; 162/200; 34/120

(58) Field of Search ..... 162/200, 273, 162/274; 34/120; 226/91–93

(56) References Cited

U.S. PATENT DOCUMENTS

| | | | | | |
|---|---|---|---|---|---|
| 4,752,519 | A | * | 6/1988 | Boyer et al. | 162/900 |
| 4,758,309 | A | * | 7/1988 | Johansson | 162/273 |
| 5,306,393 | A | | 4/1994 | Rhyne | 162/200 |
| 5,429,719 | A | | 7/1995 | Rhyne | 162/200 |
| 5,466,339 | A | * | 11/1995 | Legge | 162/200 |

* cited by examiner

*Primary Examiner*—Karen M. Hastings
(74) *Attorney, Agent, or Firm*—Frommer Lawrence & Haug LLP; Ronald R. Santucci

(57) ABSTRACT

A leader having a shape substantially that of a triangle which is used to pull a seamable papermaker's fabric onto a paper machine comprising a plastic coated substrate having plastic reinforcing strips thereon.

13 Claims, 8 Drawing Sheets

LEADER DEVICE FOR INSTALLATION OF ON MACHINE SEAMABLE PAPERMAKER'S FABRICS AND BELTS

This application claims benefit of U.S. Provisional Application No. 60/163,016 filed Nov. 2, 1999.

FIELD OF THE INVENTION

The present invention is directed towards a leader used to pull a seamable papermaker's fabric onto a paper machine particularly one that is durable and allows its reuse.

BACKGROUND OF THE INVENTION

Fabrics in modern papermaking machines may have a width of from 5 to over 33 feet, a length of from 40 to over 400 feet and weigh from approximately 100 to over 3,000 pounds. These fabrics wear out and require replacement. Replacement of fabrics often involves taking the machine out of service, removing the worn fabric, setting up to install a fabric and installing the new fabric. While many fabrics are endless, about half of those used in press sections of the paper machines today are on machine seamable. All dryer fabrics used all have a seam of some type. Some Paper Industry Process Belts (PIPBs) are contemplated to have an on machine seam capability, such as some transfer belts, known as Transbelt®. Installation of the fabric includes pulling the fabric body onto a machine and joining the fabric ends to form an endless belt.

An important aspect of loading a fabric body onto a paper machine is that there be uniform tension across the fabric. If uniform tension is not achieved and one section of the fabric pulls more than another, then the fabric can bubble or ridge across the fabric width.

Another aspect of loading a fabric body is preventing damage to the fabric body seam. In order to avoid or minimize the chance of damage to the seam during installation, tension, weight and pressure must be avoided on the seam itself.

A further aspect of loading a fabric, especially very long ones is properly aligning the fabric body in the machine so the fabric guides true in the machine direction (MD) and does not oscillate or track to one side of the machine. If the fabric guides or tracks poorly it can make contact with the paper machine support frame and cause fabric damage.

For fabrics and belts with seams that can be joined together on the paper machine, various types of leaders have been tried to assist installation. In order to avoid or minimize the potential for damaging the fabric body and the machine during installation and operation, the leader should be designed so there is uniform tension across the fabric body. There have been several attempts to design such leaders.

U.S. Pat. Nos. 5,306,393 and 5,429,719 both to Rhyne describe a device and method for installing a fabric body onto a paper machine. The method includes providing a self-aligning fabric loading harness having a leading edge and a plurality of spaced empty grommets disposed adjacent to the leading edge, to which multiple ropes are attached, securing a pull rope through loading harness and a line receiving device, pulling the pull rope, and automatically readjusting the pull rope through the loading harness to attempt to achieve uniform tension across the fabric.

Some leaders are square or rectangular, with the long dimension to either the MD or CD. Multiple ropes or straps are attached to the leader at evenly spaced apart locations across the width of the leader, and the leader with the attached papermaker's fabric or belt is pulled through the fabric run, and the ends of the papermaker's fabric or belt are brought together and joined by a seam to make the fabric endless. The leader is removed and the fabric is ready for use. However, the multiple ropes or straps can get hung up on the stationary equipment in the fabric run, causing difficult and time consuming installation, if not tearing and damage of the fabric.

There are also leaders currently used in the industry which are shaped like an isosceles triangle, having the apex removed to form a trapezoid. The leaders are fabricated from a woven material. The material can also be a nonwoven from which the leader is fabricated. The base of a leader has a zipper, which is used to attach the leader to an end of the fabric being installed on the paper machine. Such a design is preferred because only one rope is attached near the apex to pull the fabric onto the machine. When the triangle is cut from woven material, one of the yarn systems in the weave goes straight from the base to the apex and the other is at a 90° angle thereto.

FIG. 1 shows a top view of a prior art leader 10. Leader 10 is shaped like an isosceles triangle and is fabricated from a woven material. The base 12 of leader 10 has a one half a zipper edge 12, which is used to attach leader 10 to an end of the fabric being installed on the paper machine to which the other half of the zipper edge is attached to the fabric or belt. Papermill personnel can attach a rope near the apex which is provided with a hole 14 and pull the fabric onto the machine. When the triangle is cut from woven material, one of the yarn systems in the weave goes straight from the base to the apex and the other is at a 90° angle thereto. When the rope is pulled as shown in FIG. 1*a*, the force is unevenly distributed across the leader as well as the attached fabric body which causes fabric body to bunch up on the sides.

Full width steel bars may be inserted at the base of the leader for better weight/tension distribution. However, the bars are heavy, thick and sometimes difficult to pass through the nip formed by two press rolls, or a shoe and opposing roll.

With a leader of this type, even with a 4 foot wide (in the cross machine direction or CD) steel reinforcing bar at the apex of the triangle/trapezoid, when the rope is pulled the force is unevenly distributed about the leader and across the attached fabric body. When the apex above is pulled, most of the force is distributed over four feet in the CD at the center of the leader. This causes the center of the fabric to bunch up, making it more difficult to seam, and often causes the edges of the fabric or belt 16 and leader 10 to droop 18 and 20 while it is being pulled onto the paper machine.

The drawback of this type of leader is that the load is always concentrated down its center. This causes both the center of the leader and the fabric attached to it, to lead the edges and form waves in the center while pulling through the machine, making it more difficult to seam as well as guide the fabric through the run during installation. This often causes the edges of the fabric to droop while it is being pulled through the fabric run. Any fabric edge droop or bunching/waviness (any departure from a relatively flat fabric profile) can cause the fabric to become hung up on stationary equipment, or to not easily pass through the gap formed between two press rolls. Attempts to correct both the fabric and leader edges from drooping by inserting ropes down the edges, usually results in the edges curling up and folding over, which is also not desirable.

While the types of methods and devices for installing an on machine seamable fabric or belt aforementioned have particular advantages, they also have attendant disadvantages discussed above.

SUMMARY OF THE INVENTION

It is therefore a principal object of the invention to overcome the shortcomings of the devices heretofore mentioned.

It is a further object of the invention to provide a device and method for installing a fabric in a paper machine which evenly distributes the load on the fabric making for easier installation and seaming.

It is a further object of the invention to provide a device for installing a fabric in a paper machine which is durable and allows for repeated use.

To solve this problem, a leader has been fashioned from at least one section of a polymeric material to form a triangle with a tapered apex. The triangle is preferably isosceles with the total leader length equivalent to the base of the leader width divided by 1.5. In preferred embodiments the leader comprises polymeric PVC (poly-vinyl-chloride) coated woven coarse fabrics woven of polyamide or polyester yarns, usually monofilaments, which are assembled together by a high frequency (H.F.) welding system. In a more preferred embodiment, additional melted strips of PVC are placed at regular intervals to reinforce the leader structure. There is a loop formed of folded over material provided at the tapered apex so that a metal bar may be placed therein with an access hold cut around a portion of the bar in the center to allow a rope or other means to be affixed to pull the leader. Depending on the fabric weight, load distribution achieved, and strength of the leader material itself, more than one rope might be attached at the apex.

The leader is attached to the fabric by an attachment means at its base. In a preferred embodiment, the leader is attached to the fabric by a zipper, one half of which zipper edge is attached to the base of the leader. Another half of the zipper is attached to the fabric. Other means suitable for this purpose might be used to attach the leader to the fabric.

DETAILED DESCRIPTION OF THE PREFERRED EMBODIMENTS

Figure 1:
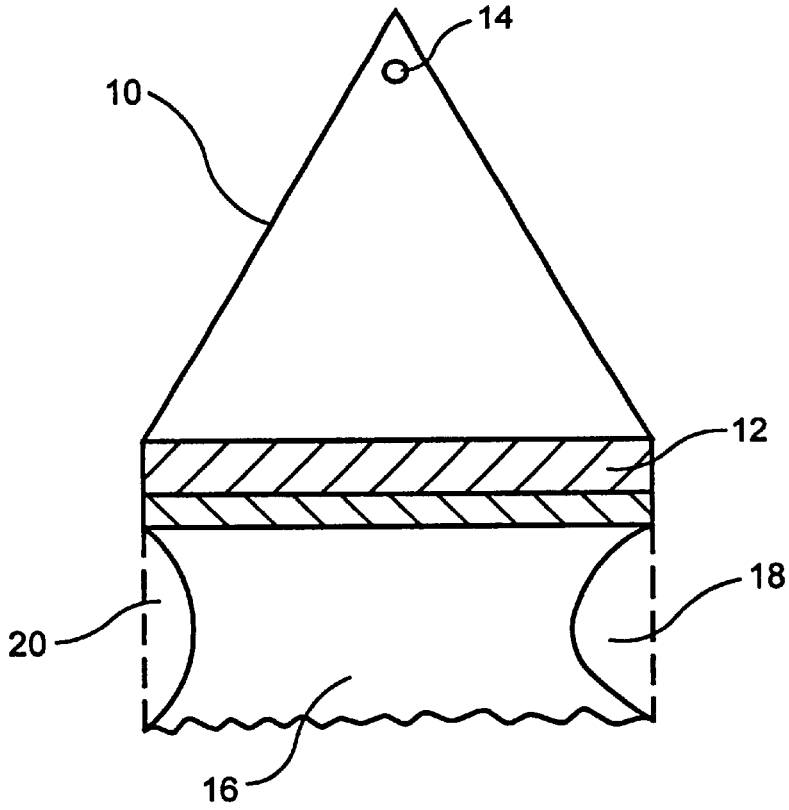
F I G. 1 PRIOR ART
FIG. 1 shows a top view of a prior art leader.
Figure 1A:
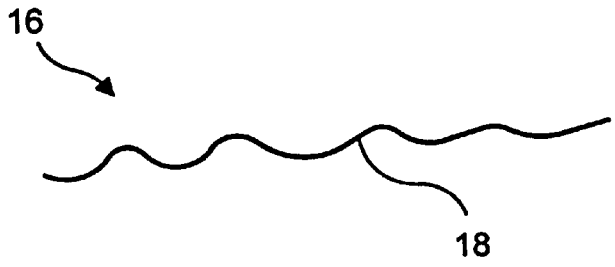
F I G. 1a PRIOR ART
FIG. 1*a* shows a side view of fabric attached to the leader of FIG. 1 after it has been pulled.
Figure 2:
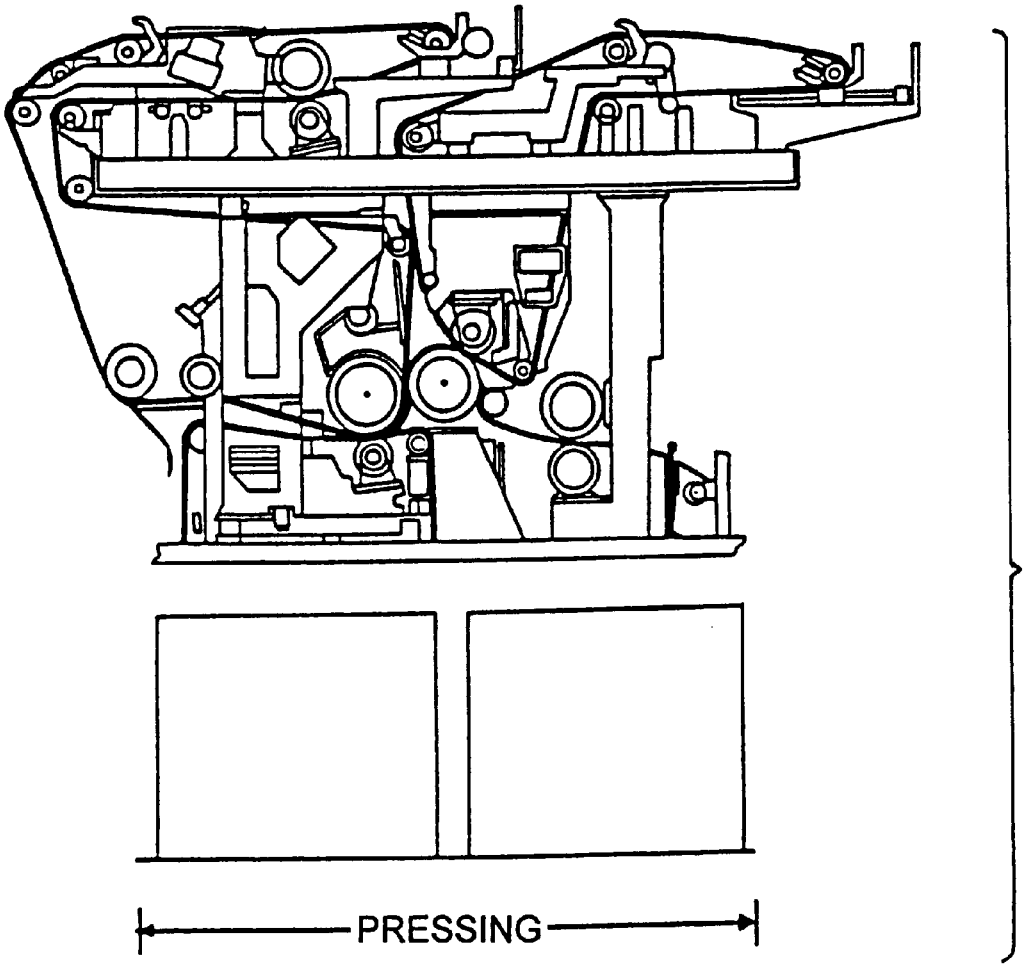
FIG. 2 shows a side view illustrating a press section used in papermaking.
Figure 3:
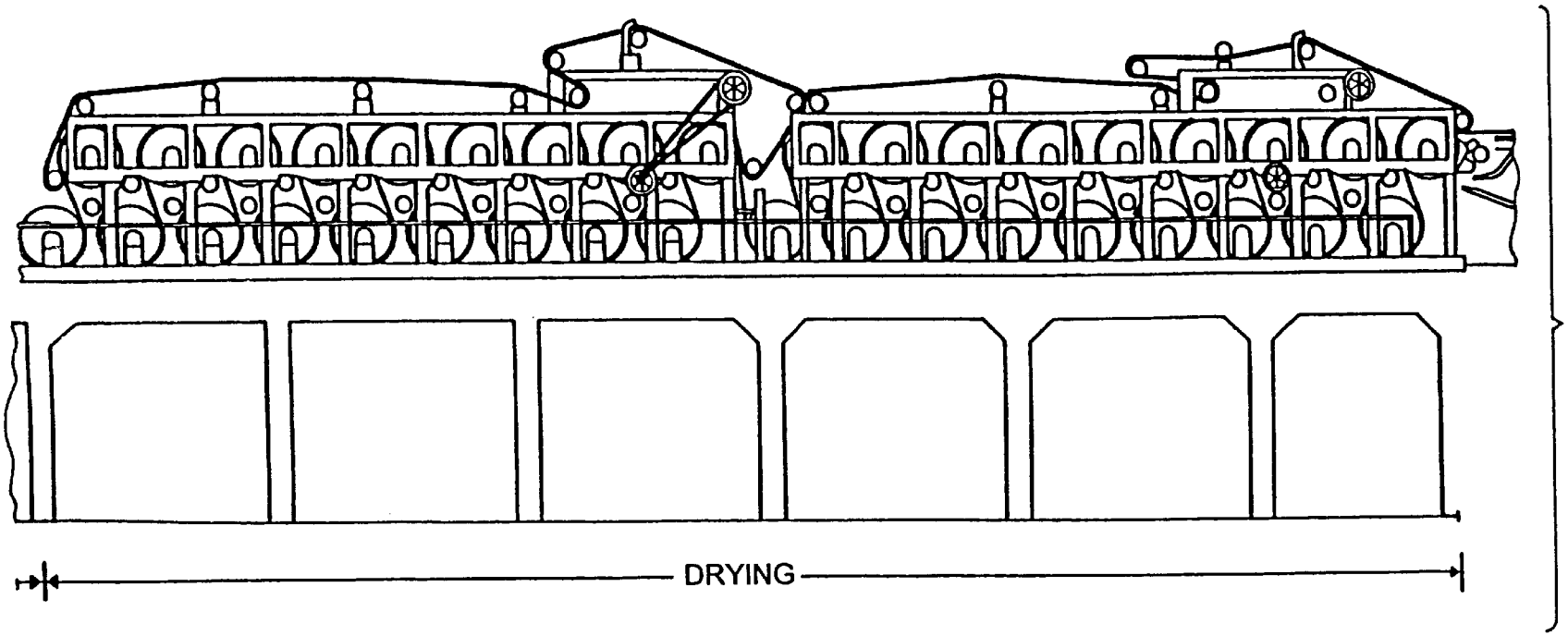
FIG. 3 shows a side view illustrating a dryer section used in papermaking.

Initially, FIG. 2 shows a side view of the press section of a papermaking machine. FIG. 3 shows a side view of the drying section of a typical papermaking machine. The path of the fabric used in these sections is illustrated therein.

Figure 4:
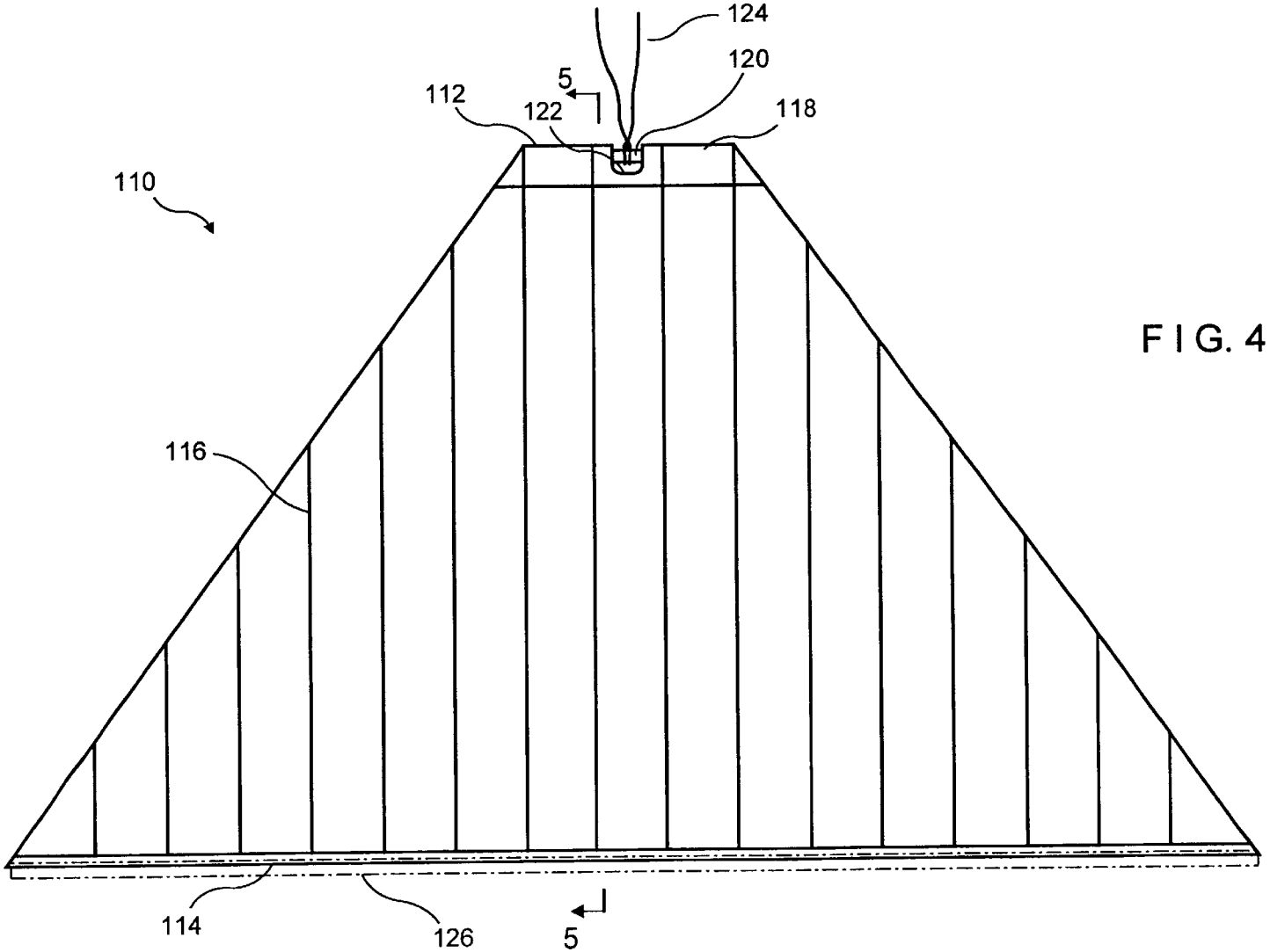
FIG. 4 shows a top view of a preferred embodiment of the present invention.
Figure 5:
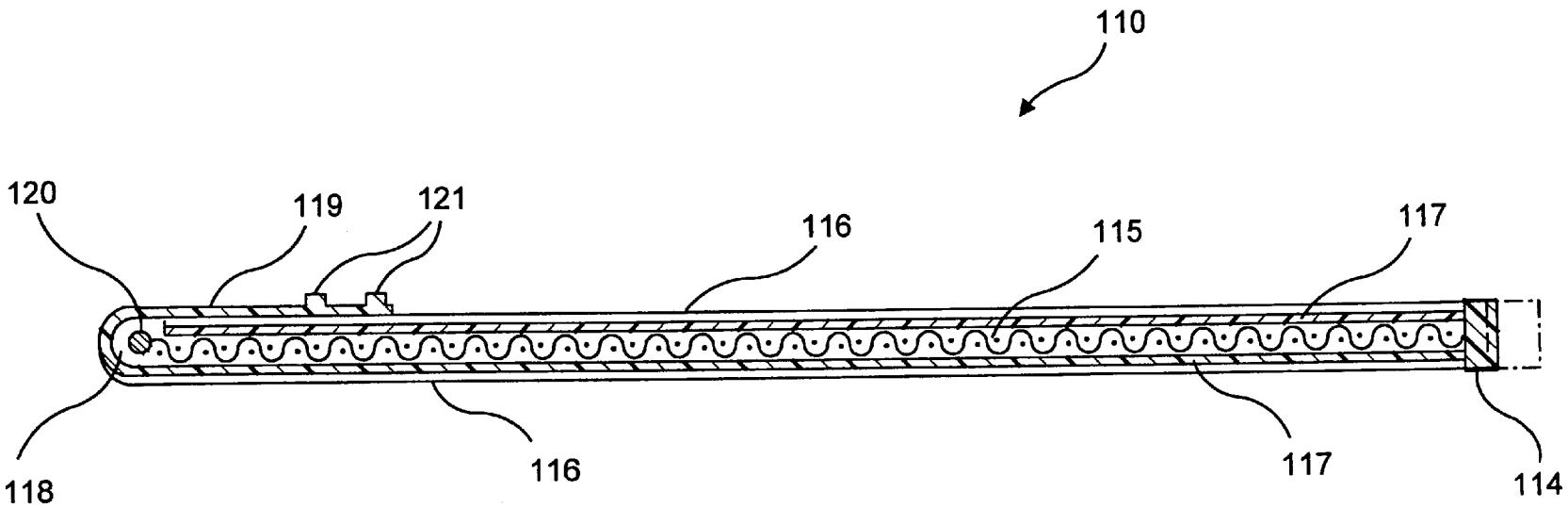
FIG. 5 is a side sectional view taken along line 5—5 of FIG. 4.
Figure 6:
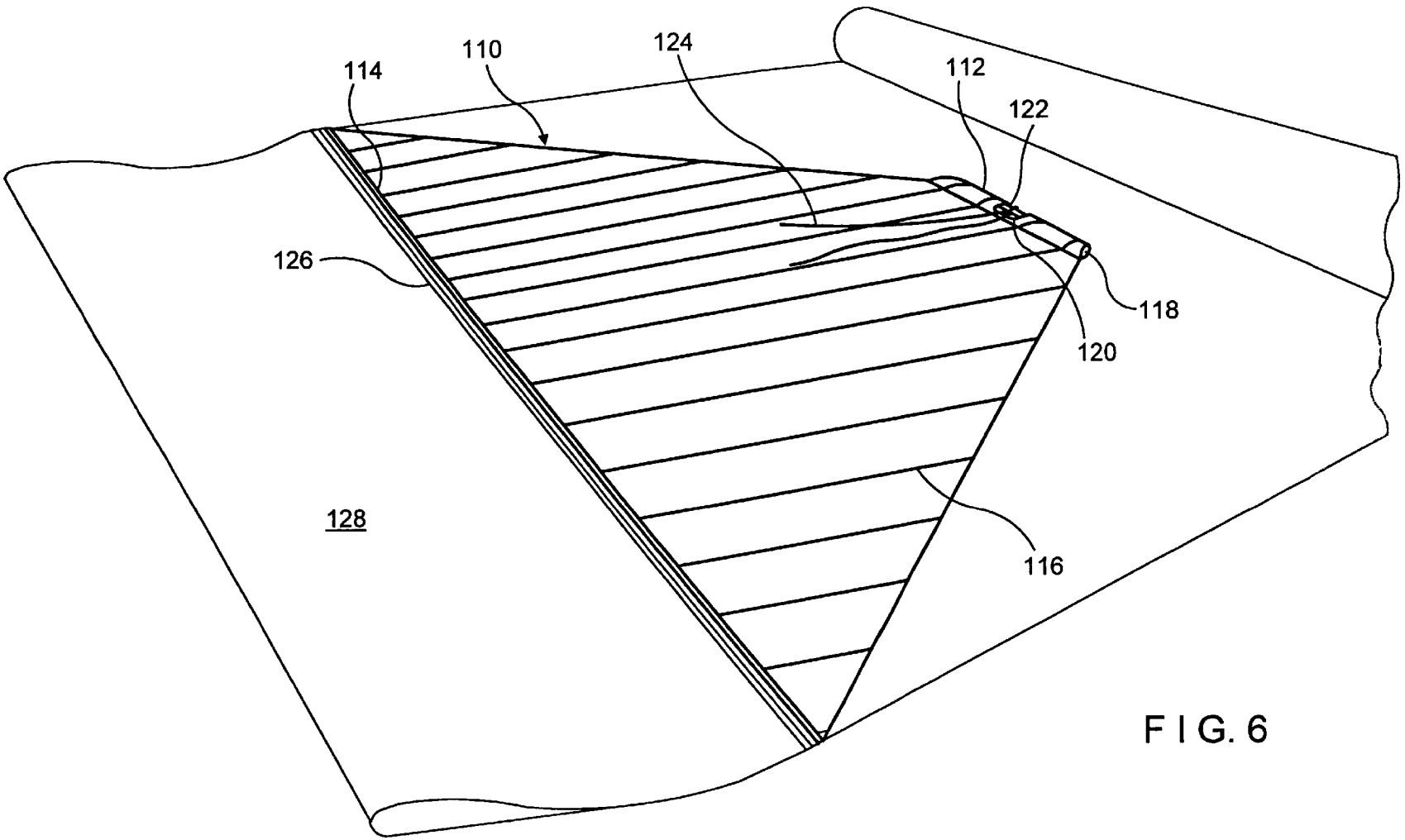
FIG. 6 shows a picture of the top view of the preferred embodiment of FIG. 4 attached to fabric.
Figure 7:
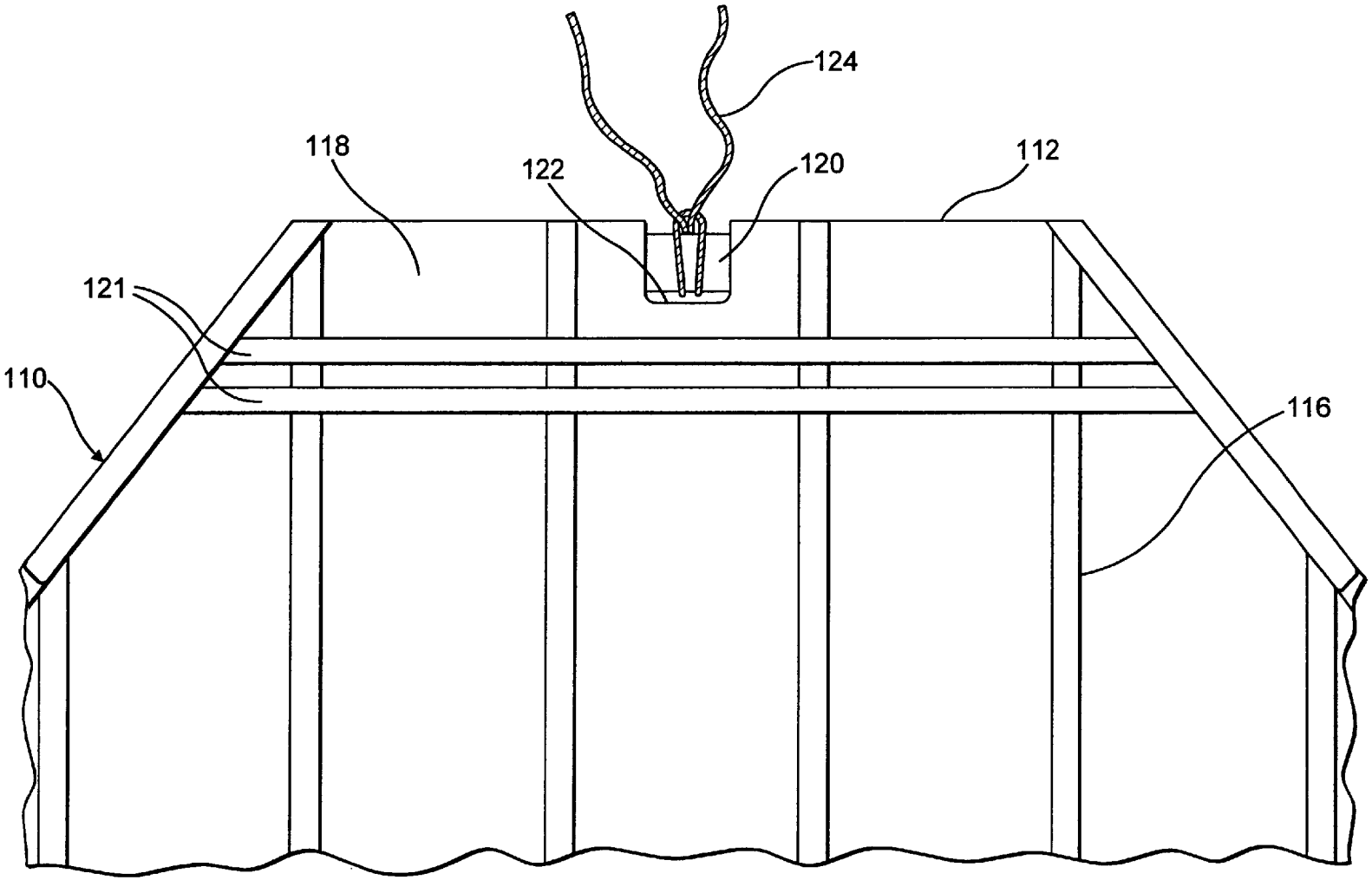
FIG. 7 shows a detailed view of a partial top view of the preferred embodiment of FIG. 4 showing the apex of the leader.
Figure 8:
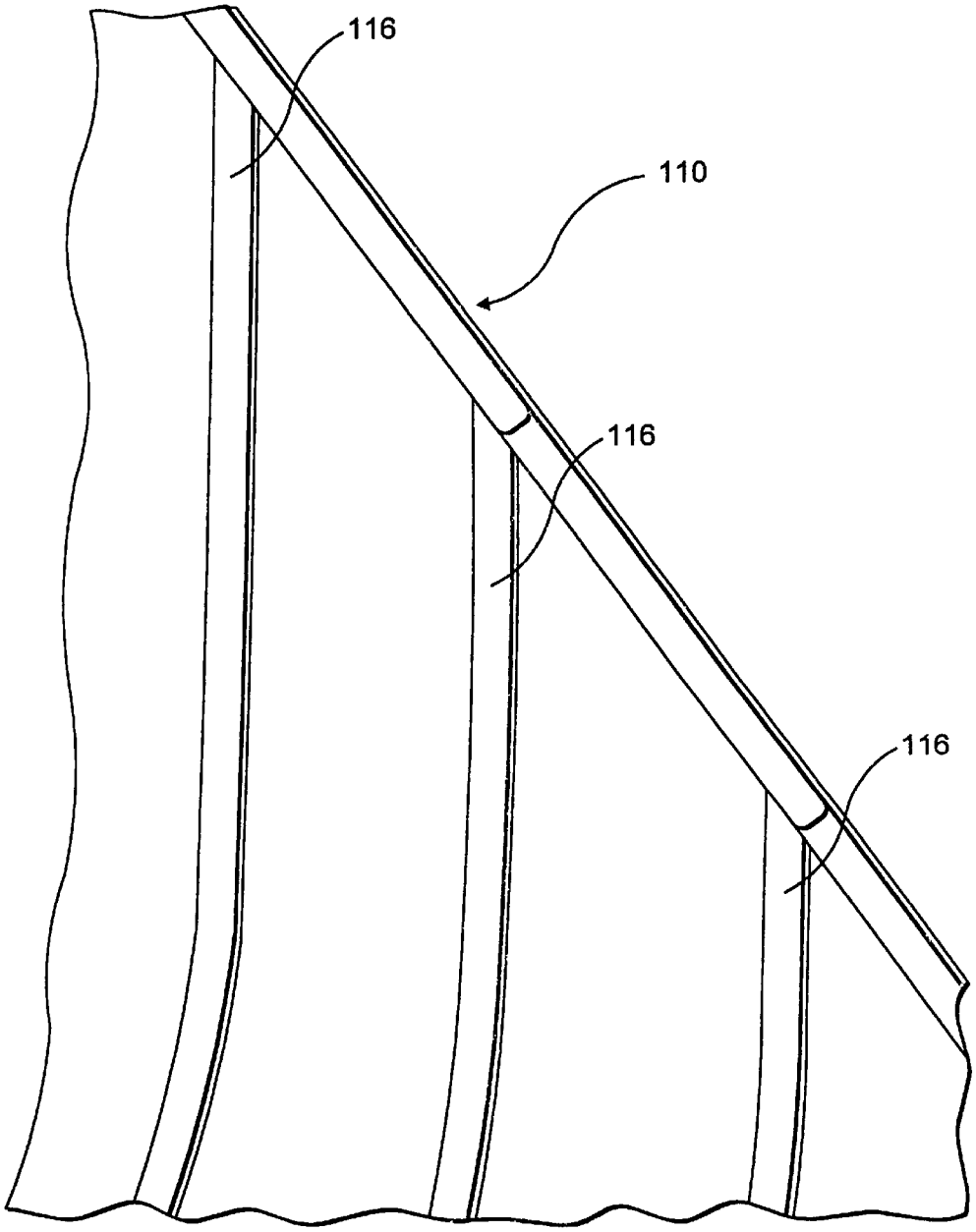
FIG. 8 shows a detailed view of a second partial top view of the preferred embodiment of FIG. 4 showing the additional melted/fused MD strips and edge strips.

FIGS. 4 and 5 show an embodiment of the present inventive leader 110. Leader 110 is shaped like a triangle with a tapered apex 112 and a base 114. The triangle is preferably isosceles. The leader substrate 115 may be made from a polyester material or other material suitable for purpose. In preferred embodiments the leader substrate 115 comprises PVC coated woven coarse fabrics which are assembled together by H.F. welding system or other means suitable for purpose. Preferably approximately 900 g/m$^2$ of PVC coating 117 is applied. To reinforce the structure melted strips 116 of PVC may be placed at regular intervals on one or both surfaces of the coated leader substrate. For example, the strips may be 2 cm wide and placed about every 15 to 20 cm apart. Strips are also folded about the sides and the base of the triangle. There is a loop 118 made by a flap 119 of folded over leader material provided at tapered apex 112 so that a metal bar 120 may be inserted through loop 118 across apex 112. The loop 118 preferably measures 10 cm in the machine direction (MD). Lateral PVC strips 121 may be positioned over the flap 118 for reinforcing purposes. An access hole 122 is cut around a portion of bar 120 in the center so that a rope 124 or other attachment means may be affixed to pull leader 110. Depending on the fabric weight, load distribution achieved, and strength of the leader material itself, more than one rope can be wrapped around the bar at the apex 112, although a single rope is preferred.

The leader is attached to the fabric by an attachment means at its base 114. In a preferred embodiment, the leader 110 is attached to the fabric by a zipper 126, one half of which zipper edge is attached to the base 114 of the leader. Another half of the zipper is attached to the fabric. Other means suitable for purpose may also be employed.

When the fabric 128 is to be installed on a paper machine, the rope is attached to the bar 120 though access hole 122 and pulled to draw the fabric 128 through and around the components of the machine. The load applied to the leader is evenly distributed across it. The edges do not droop and the load distribution is very uniform. Furthermore, the rugged design of the leader allows for its repeated use with relatively heavy loads. The leader design may be further enhanced by use of a different layer of stronger material, or by using more than one layer of material such as sheets of woven polypropylene yarns or tapes, properly oriented with respect to one another to maximize load distribution, forming a reinforced multilayer structure. In another alternative, different polymeric coatings can be used such polyurethane, or coatings that are biodegradable in some manner once the leader has reached its useful life.

In addition, while a woven coarse fabric has been referred to, non-woven materials, including reinforced and non-reinforced spunbonds might also be used. Knitted material can also be used. Also, the cost may also be reduced by reducing overall leader length (height of triangle) for some leaders, either for heavy fabrics or very wide fabrics. Tri-axial woven material can also be used.

Leader design distributes the load in an even manner allowing easier seaming since the fabric is flat. The leader also pulls the fabric onto the machine uniformly due to the load distribution which keeps the fabric flat and prevents contact with stationary elements such as suction boxes or showers.

Furthermore, the design does not usually require the use of multiple ropes across the width which is commercially undesirable. Nor does the design require multiple straps or thick, heavy, full width metal bars which have known disadvantages.

Thus by the present invention its advantages will be realized and preferred embodiments have been disclosed and described herein.

What is claimed is:

1. A fabric loading leader substantially in the shape of a triangle having two sides and a base and an apex for installing a papermaker's fabric having a leading edge, said leader comprising:

a) a substrate of material comprising a material coated with a polymeric coating providing a first surface and a second surface with the substrate therebetween;

b) reinforcing strips positioned at intervals on the first surface extending in a direction from the base to the apex and structured and arranged so that the leader will evenly distribut the pulling load on the fabric being installed;

c) a first attachment means along the base to attach the base to the leading edge of a papermaker's fabric; and d) a second attachment means near the apex for attaching the leader thereto.

2. The fabric loading leader according to claim 1 which includes reinforcing strips on the second surface extending in a direction between the base and apex.

3. The fabric loading leader according to claim 1 wherein the polymeric coating and reinforcing strips are made of polyvinyl chloride.

4. The fabric loading leader according to claim 2 wherein the polymeric coating and reinforcing strips are made of polyvinyl chloride.

5. The fabric loading leader according to claim 1 which includes a loop formed from a portion of the leader folded over at the apex.

6. The fabric loading leader according to claim 5 which includes a metal bar disposed in said loop.

7. The fabric loading leader according to claim 3 which includes reinforcing strips folded about the sides and the base of the leader.

8. The fabric loading leader according to claim 1 wherein the first attachment means is a zipper.

9. The fabric loading leader according to claim 1 wherein the triangle is an isosceles triangle.

10. The fabric loading leader according to claim 7 wherein the reinforcing strips are attached to the leader by ultrasonic welding.

11. The fabric loading leader according to claim 1 wherein the substrate is woven.

12. The fabric loading leader according to claim 1 wherein the substrate is a nonwoven material.

13. The fabric loading leader according to claim 1 wherein the substrate comprises more than one layer of woven or nonwoven material.

* * * * *